United States Patent [19]

Ramser

[11] 4,449,902

[45] May 22, 1984

[54] APPARATUS FOR CONTROL OF PARTICLE SIZE IN THE PRODUCTION OF ATOMIZED METAL

[75] Inventor: Robert A. Ramser, New Kensington, Pa.

[73] Assignee: Aluminum Company of America, Pittsburgh, Pa.

[21] Appl. No.: 440,967

[22] Filed: Nov. 12, 1982

[51] Int. Cl.[3] ..... B22F 9/00

[52] U.S. Cl. ..... 425/7

[58] Field of Search ..... 425/7

[56] References Cited

U.S. PATENT DOCUMENTS

| | | | |
|---|---|---|---|
| 1,036,689 | 8/1912 | Neil | 264/12 |
| 1,306,060 | 6/1919 | Hall | 264/14 |
| 1,545,253 | 7/1925 | Hall | 239/591 |
| 2,159,433 | 5/1939 | Ervin | 425/7 |
| 2,402,441 | 6/1946 | Paddle | 83/91 |
| 2,460,993 | 2/1949 | Brasse et al. | 425/7 |
| 2,638,626 | 5/1953 | Golwynne | 425/7 |
| 2,638,627 | 5/1953 | Golwynne | 18/2.5 |
| 2,638,630 | 5/1953 | Golwynne | 18/47.3 |
| 2,639,006 | 5/1953 | Golwynne | 183/85 |
| 3,293,334 | 12/1966 | Buland et al. | 264/12 |
| 3,564,082 | 2/1971 | Kartenbeck | 264/12 |
| 3,771,929 | 11/1973 | Hellman | 425/7 |
| 4,177,026 | 12/1979 | Honnorat et al. | 425/7 |
| 4,207,040 | 6/1980 | Metcalfe et al. | 425/8 |
| 4,272,463 | 6/1981 | Clark et al. | 264/12 |

*Primary Examiner*—James R. Hall

*Attorney, Agent, or Firm*—Andrew Alexander

[57] ABSTRACT

In accordance with the invention, apparatus for the production of atomized metal is provided comprising a containment vessel having a sidewall terminating in an end wall through which atomizing gas and molten metal from a molten metal source enter the vessel through nozzle means sealed thereto. A restricted air ingress port is provided in the vessel spaced from the end plate, the sidewall and the end plate cooperating with the nozzle means to seal off the interior of the vessel and the metal particles therein from the area adjacent the source of molten metal. The source of molten metal includes a reservoir having at least a portion above the nozzle means whereby the metal level in the reservoir provides an adjustable pressure head for the metal entering the vessel through the nozzle means which is adjusted by varying the level of the molten metal in the reservoir.

10 Claims, 4 Drawing Figures

APPARATUS FOR CONTROL OF PARTICLE SIZE IN THE PRODUCTION OF ATOMIZED METAL

BACKGROUND OF THE INVENTION

This invention relates to the production of atomized metal powder and more particularly to improved apparatus for the production of atomized metal powder in a safer and more efficient manner.

The production of atomized powder of metals, such as aluminum, magnesium and the like, carries with it the attendant risk of explosion.

Conventionally, therefore, atomized metal powder is produced using a containment or chilling chamber into which the atomized metal stream is injected through an open end of the chamber positioned adjacent the atomizer and a liquid metal reservoir, the atomized metal stream being cooled or chilled with air introduced through the open end by a downstream exhaust fan. Such a system can result in safety hazards because any explosion occurring in the system can propagate backwards to the open-ended chiller chamber, often exposing operating personnel to hazardous conditions. Furthermore, the release of resultant burning aluminum particles with intense heat radiation through the open end of the containment vessel upon occurrence of an explosion can also result in further safety hazards.

While the use of a closed atomizing apparatus using a vertical updraft chiller chamber has certain advantages, it would be desirable to control the molten metal pressure to the atomizing nozzle to compensate for variations in chamber pressure, thereby affording greater control of particle size. This is particularly true when the system is designed to operate above atmospheric pressure using a "pushing" system with a blower to push the sweeping gas into the system as opposed to operating below atmospheric pressure using an eductor exhaust system, e.g., eductor, to pull the sweeping gas into the system.

The present invention solves these various problems in the prior art by providing a system which will permit adjustment of molten metal pressure and will also contain the gases and burning particles should an explosion occur.

SUMMARY OF THE INVENTION

It is, therefore, an object of the invention to provide apparatus for the production of atomized metal which will mitigate and contain the effects of uncontrolled oxidation reactions by the atomized metal particles.

It is another object of the invention to provide apparatus for the production of atomized metal which will inhibit the occurrence of uncontrolled oxidation reactions by the atomized metal particles.

It is yet another object of the invention to provide apparatus for the production of atomized metal which provides variable pressure on the molten metal to be atomized.

It is a further object of the invention to provide apparatus for the production of atomized metal where means are provided to control the pressure of the molten metal to be atomized.

These and other objects of the invention will become apparent from the description and accompanying drawings.

In accordance with the invention, apparatus for the production of atomized metal is provided comprising a containment vessel having a sidewall terminating in an end wall through which atomizing gas and molten metal from a molten metal source enter the vessel through nozzle means sealed thereto. A restricted air ingress port is provided in the vessel spaced from the end plate, the sidewall and the end plate cooperating with the nozzle means to seal off the interior of the vessel and the metal particles therein from the area adjacent the source of molten metal. The source of molten metal includes a reservoir having at least a portion above the nozzle means whereby the metal level in the reservoir provides an adjustable pressure head for the metal entering the vessel through the nozzle means which is adjusted by varying the level of the molten metal in the reservoir.

DETAILED DESCRIPTION OF THE PREFERRED EMBODIMENTS

Figure 1:
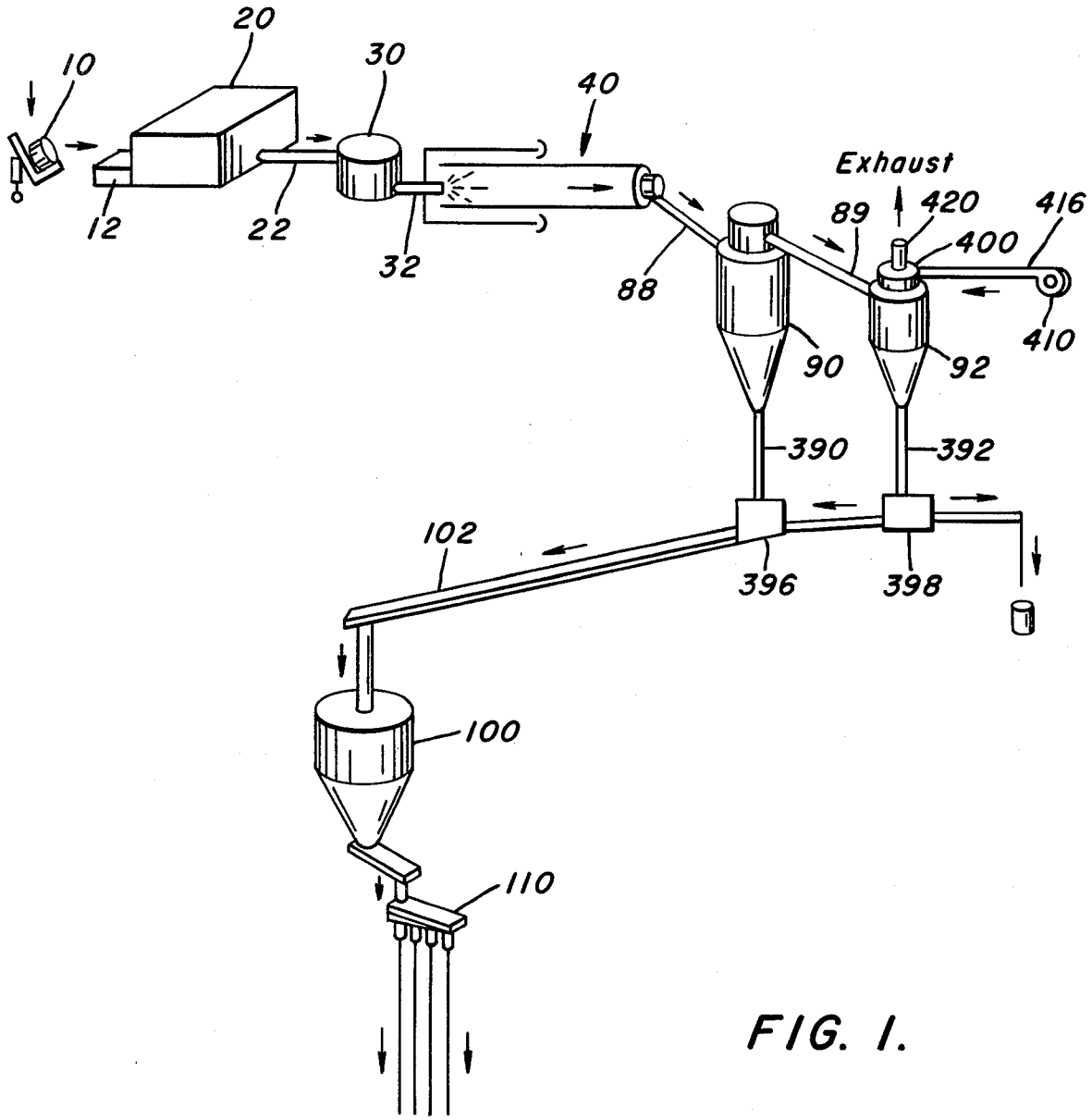
FIG. 1 is a schematic flowsheet of the atomized metal product apparatus.

Referring now to the drawings, FIG. 1 illustrates, schematically, the apparatus for producing and handling atomized metal powder from molten metal which may be provided from a molten metal crucible 10 or an ingot 12 which is charged to a holding/melting furnace 20 connected via duct 22 to a reservoir 30 adjacent containment vessel 40. One or more atomizing nozzles 32 are mounted to vessel 40 to provide communication with the molten metal in reservoir 30.

The atomized metal produced in vessel 40 is swept out of vessel 40 through duct 88 to primary cyclone separator 90 which passes the coarse particles to powder tank 100 via conveyor 102. Finer particles, including fines, are removed from the air stream in one or more secondary cyclone separators 92 from whence they may be passed to powder tank 100 or separately packaged. The fines may be packaged separately or reblended with the coarser particles if a wider particle size distribution is desired.

Figure 2:
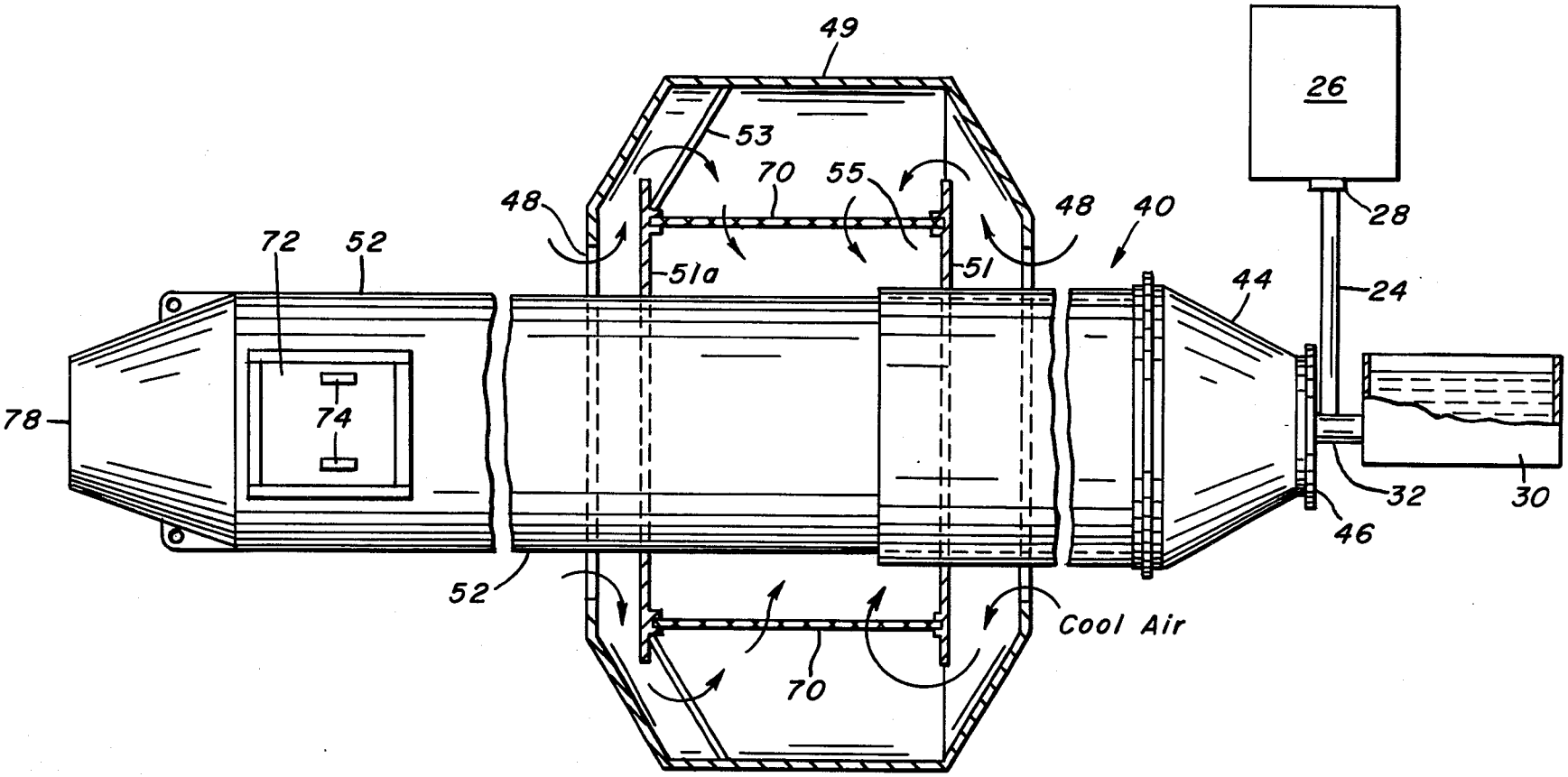
FIG. 2 is a side view partially in section of the containment vessel.
Figure 3:
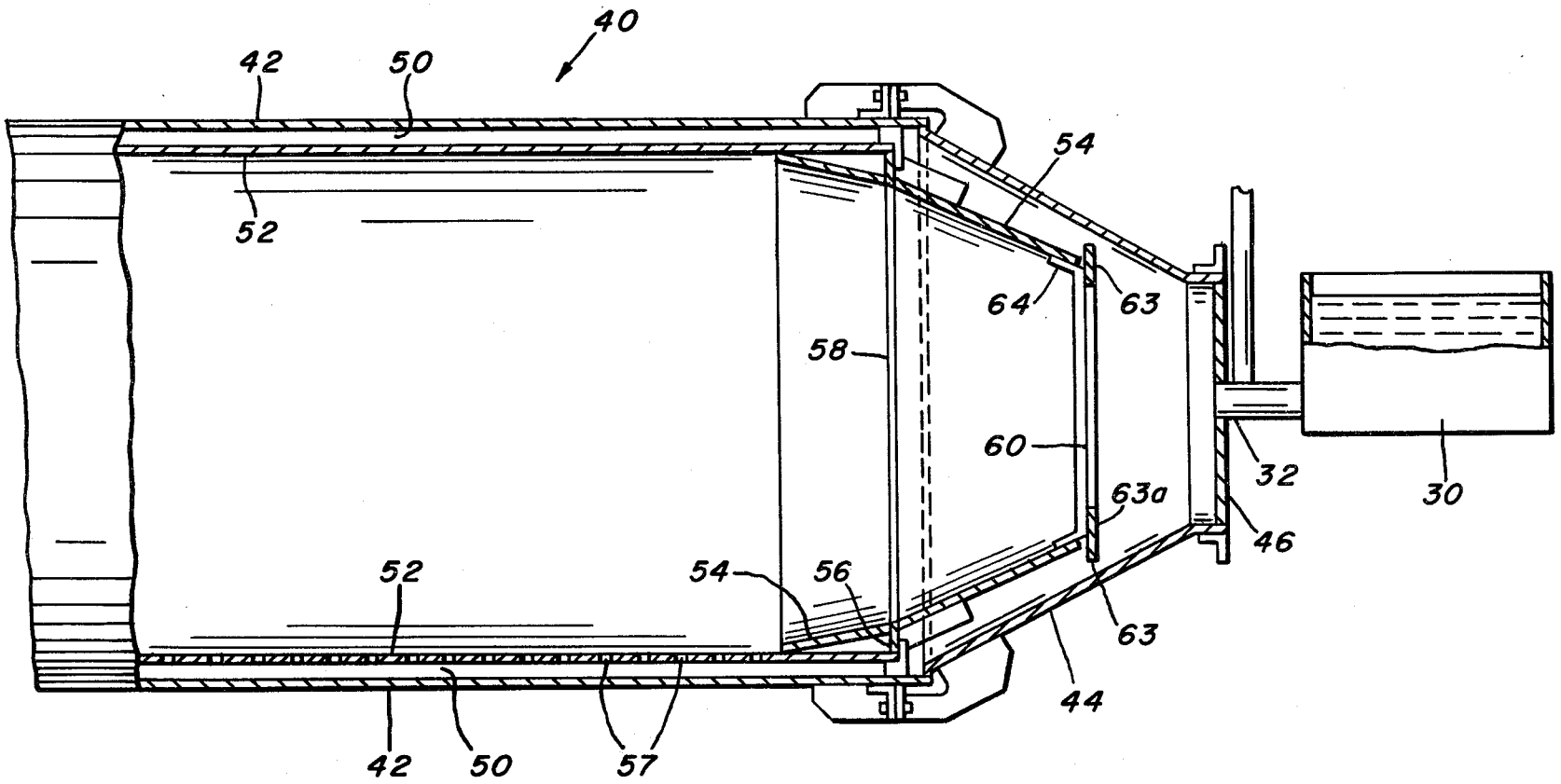
FIG. 3 is a side section view of a portion of the vessel shown in FIG. 2.

Containment vessel 40, as shown in more detail in FIGS. 2 and 3, comprises an outer cylindrical shell 42 terminating at one end in a truncated cone 44 to which is mounted end plate 46 which carries nozzles 32. End plate 46 seals off the end of cone 44 except for the openings for nozzles. This provides essentially a closed containment vessel or chiller chamber 40, particularly with respect to the area in which the nozzles are mounted.

Shell 42 is provided with an opposite, open end 48 which provides an air entry for the cooling and collecting gases, e.g. air, introduced into containment vessel 40 in accordance with the invention, as will now be described.

Concentrically mounted within the portion of outer cylindrical shell 42 adjacent end plate 46 is a second cylinder 52 (FIG. 3) of sufficiently smaller outer diameter to define an annular passageway 50 between cylinders 42 and 52. In FIG. 3, it will be seen that cylinder 52 is provided at one end with a conical member 54 which may be welded or fastened at 56 to a ring 60 which is spaced or suspended below the lower end of conical member 54 to provide an opening therebetween. Ring 60 has an outer edge portion 63 which protrudes into the extension of annular passageway 50 defined by the walls of truncated cone 44 and conical member 54. Outer edge portion 63 serves to flow or channel air into vessel 52 for purposes to be explained later. Referring again to FIG. 3, it will be seen that ring 60 may be suspended from truncated member 54 by members 64.

Cool air is pulled into vessel 40 by eductor means 400, for example, shown in FIG. 1. The air enters the annular opening 48 (FIG. 2) of outer cylinder 42, passes through filters 70 into annular passageway 50 and into the end of vessel 40 adjacent nozzles 32. This cool air, passing through annular passageway 50, at a velocity in the range of about 1000 to 6000 ft./min., serves to keep the inner wall of vessel 40, i.e., the wall of cylinder 52, cool thereby inhibiting particle deposition thereon.

Annular opening 48 is defined by a shield member 49 and annular ring 51. Shield member 49 is supported and fastened to annular ring 51*a* and member 53, which in turn are secured to vessel 40 to inhibit water or other materials being ingested during operation, particularly when this part of the vessel is exposed to the atmosphere. It will be appreciated that during operation, in one embodiment, large volumes of air are ingested through opening 48 for cooling the walls of the chiller chamber of containment vessel 40 and for purposes of carrying the atomized powder out of the vessel. From FIGS. 2 and 3, it will be seen that the annular passageway 50 between inside vessel 52 and outside vessel 42 opens into annular opening 48.

Filters 70 may be any conventional filters used for filtering air and are disposed annularly around the periphery of rings 51 and 51*a* and secured thereto by conventional means.

It should be noted that the intake has been shown as spaced apart from both the end plate and nozzles to provide an isolation of the air intake from the nozzle and external molten metal to mitigate hazardous conditions. Other structural configurations to accomplish this result can also be used, such as one-way check valves or other labyrinth structures.

In another aspect of the invention, it has been found that the temperature of cylinder wal 52 is important. That is, it has been found that if the temperature of the wall is permitted to substantially exceed 300° F., the molten metal, e.g., aluminum, in atomized form, has a tendency to stick or become adhered to the cylinder wall in substantial quantities and subsequently break loose, causing unsafe conditions. Accordingly, it has been found, for example, with respect to aluminum, that sticking is minimized or is virtually eliminated by lowering the wall temperature of cylinder 52 to preferably less than 250° F. with a typical temperature being less than 225° F. The temperature of the wall of cylinder 52 can be lowered by the collection air introduced at annular opening 48.

To provide for cooling of the walls by using collection air, the materials used in construction of the inner cylinder wall 52 should be selected with heat transfer characteristics as well as more conventional corrosion characteristics in mind. For example, it is preferred that materials, such as stainless steels or chrome plated materials, such as chrome copper or the like, should be selected.

The molten metal in reservoir 30 is initially aspirated therefrom through nozzle 32 by means of the atomizing gas introduced to the nozzle. The atomizing gases, either hot or cold, may be inert gases or other gases. Similarly, the collecting gases may be either hot or cold (but preferably cold), and may be either inert gases or other gases provided with a predetermined amount of oxidizing gases to provide a minimum protective oxidation layer on the particle surface to minimize any subsequent oxidation reactions upon exposure to the collecting gases, such as air, which both cool and sweep the metal particles out of containment vessel 40.

Ring 60 is provided with an outer edge portion 63, as noted above, which protrudes into the portion of the annular passageway 50 between truncated cone 44 and conical member 54. Outer edge portion 63, because of its spacing with respect to conical member 54, restricts and redirects a portion of the air and serves to thereby project or propel the metal particles to aid in transport of the metal particles to the discharge end of chiller chamber 40 without drop-off on the bottom of the chamber.

To further assist in preventing drop-off of metal powder from the particle stream and accumulation along the bottom of chiller chamber 40, a series of small openings 57 may be placed in cylinder 52, as shown in FIG. 3, thereby permitting some of the air entering chiller chamber 40 via annular passageway 50 to be diverted directly into cylinder 52. In this way, such metal particles are prevented from accumulating at the bottom of the vessel and interfering with the atomizing process.

Additionally, a jet of air may be directed along the bottom of chamber 40 from plate 46 to clear out any particle accumulations and to further sweep the metal particles toward discharge or exit port 78. Such a jet of air could be continuous or could be activated only when needed. A convenient source of such a jet which may be used is the atomizing air source.

Inner cylinder 52, which comprises the inner wall of vessel 40, tapers at the opposite end into an exit port 78 permitting the metal particles egress to duct 88 which carries them to cyclone separator 90. The portion of cylinder 52 adjacent the opposite end may also be provided with one or more pressure relief hatches 72 releasably mounted on and forming a portion of the wall of cylinder 52. Preferably, such hatches, when used, are releasably attached to cylinder wall 52 by a restraining means, such as hinge means to inhibit the hatch from blowing away upon a sudden buildup in pressure.

Nozzle 32 is removably mounted between end plate 46 and reservoir 30. Nozzle 32 is provided with a center bore through which flows molten metal to be atomized. Nozzle 32 is in communication with reservoir 30 containing the molten metal. Air, under pressure, enters nozzle 32 via tube 24 and is emitted adjacent the central bore at the end of the nozzle connected to end plate 46 to atomize the molten metal. Atomizer portion of nozzle 32, which forms no part of the present invention, may be constructed in accordance with well known principles of atomization construction, such as, for example, shown in Hall U.S. Pat. No. 1,545,253.

Tube 24 may be detachably connected to a manifold 26 through a quick-disconnect seal fitting 28 (FIG. 2) to facilitate easy removal of tube 24. Manifold 26 serves to provide an even distribution of gas pressure when a plurality of nozzles are used.

Nozzle 32, if used singly, may be coaxially positioned in vessel 40 to permit central current flow of the gases and metal particles. If a plurality of nozzles are used, they may be concentrically mounted about the axis of vessel 40 for the same reason, or for convenience in handling, may be mounted in rows.

As shown in FIGS. 2 and 3, vessel 40 may be positioned in a horizontal position adjacent reservoir 30. Nozzle 32 interconnects with vessel 40 and reservoir 30 to permit gravity flow of the molten metal from reservoir 30 into nozzle 32 where it is then aspirated into vessel 40 via the atomizing gas passing through tube 24 into nozzle 32. In this manner, the level of molten metal in reservoir 30 provides a pressure head for the metal flowing into nozzle 32. This pressure may be adjusted, as desired, by raising or lowering the level of molten metal within reservoir 30.

Figure 4:
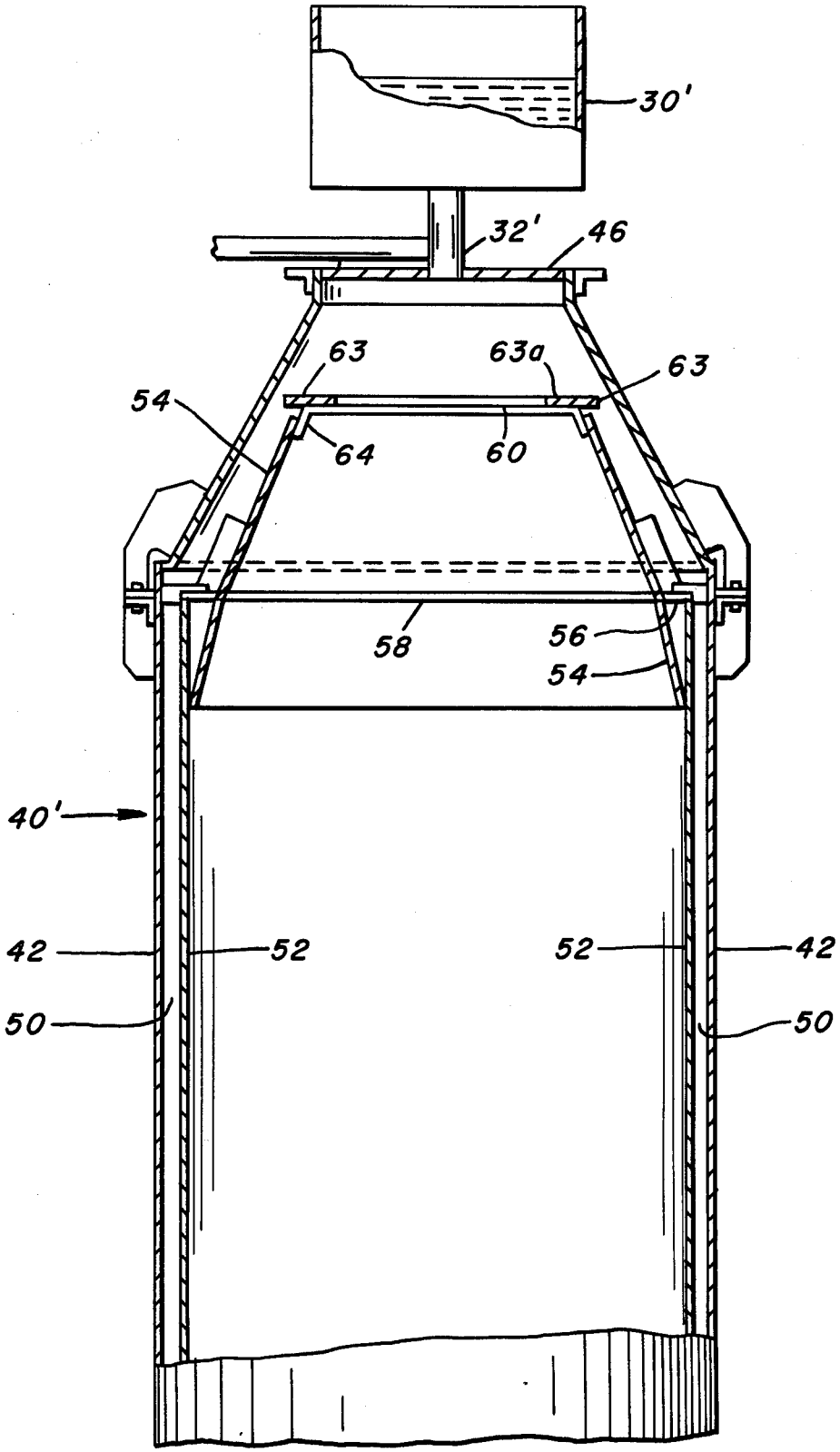
FIG. 4 is a fragmentary side section view of another embodiment of the invention.

In FIG. 4, an alternate embodiment is illustrated wherein reservoir 30' and nozzle 32' are positioned above vessel 40' which, in this embodiment, is mounted in a vertical position to operate in a down-draft manner. Except for the difference in physical placement of nozzle 32' and reservoir 30' with respect to vessel 40', the structure and functioning of the elements comprising the systems of FIGS. 2 through 4 are identical. As in the embodiment illustrated in FIGS. 2 and 3, the pressure on the molten metal entering nozzle 32' in FIG. 4 is controlled by the molten metal level in reservoir 30'. Thus, in either embodiment, the particle size of the atomized metal may be further controlled in accordance with the invention by controlling the pressure of the molten metal in the nozzle as the metal is atomized.

The sweeping gas used to sweep or remove the atomized metal particles from vessel 40 may be either forced into vessel 40 in a "push" system or may be pulled into vessel 40. In the latter instance, an eductor or aspirator which provides or creates a suction effect may be used to collect or sweep the metal particle stream out of vessel 40. As shown in FIG. 1, eductor 400 may be mounted to the last cyclone 92 and connected to one or more eductor blowers 410 which sweep an air stream through duct 416 to eductor 400. The air stream exits to the atmosphere from eductor 400 through exit port 420. Within eductor 400 is a Bernoulli tube which extends from eductor 400 into cyclone separator 92. As air is pumped through eductor 400, a vacuum is created in the Bernoulli tube which drops the pressure in cyclone 92. This creates a pulling effect in duct 89 which is passed back through cyclone 90 to duct 88 to vessel 40. Cooling air is thereby sucked into vessel 40 through the opening 48 and annular passageway 50 without any fans in the metal particle gas stream.

An eductor or aspirator suitable for use in this application may be purchased from the Quick Draft Company.

The term "aspirating means" as used herein is defined as pulling collecting gases into the atomizing or cooling chamber without use of mechanical devices, e.g., fans, in the atomized particle stream for drawing the collecting gases and atomized particles through the system. That is, the use of the term "aspirating means" is meant to include means, such as devices using Bernoulli tubes whereby the collecting or sweeping gases are drawn into the system. However, it will be understood that devices, such as fans or blowers, etc. (external to the atomized particle flow), can be used to force air or gases into Bernoulli tubes and the like for purposes of drawing gases through the atomizing system.

A pushing system may also be used in the practice of the invention, either singly or in combination with the pulling system. For example, fans, or other air-pushing means, such as compressed air or the like, may be connected to opening 48 for purposes of forcing the collecting gases into and through the system.

It should be noted, however, that in either of these embodiments, the collecting air is swept through the system without the particles coming in contact with any air moving means, such as fans or the like. Thereby, the attendant problems with such fans have been successfully avoided in the practice of this invention.

It will be further understood that with the eductor system just described, a subatmospheric condition is created adjacent the nozzles on plate 46. However, with the use of a pushing device, as referred to immediately above, a greater than atmospheric condition can be obtained in vessel 40. Thus, it will be understood that a combination of the push and pull systems may be blended in order to get a controlled atmospheric pressure adjacent the nozzles during operation or slightly above or slightly below if it is desired to operate in these areas, depending to some extent on the type of particle desired.

While such variations in the operating pressure within vessel 40 may have an effect on the particle size of the atomized metal, such effects may be compensated or adjusted for, in accordance with the invention, by varying the pressure of the molten metal entering the nozzle by varying the level of molten metal with the reservoir in accordance with the invention.

While the invention has been illustrated in the horizontal and down-draft position, it will be understood that the principles involved can be applied to a vertical updraft chamber. It will be understood that the pressure for the molten metal can be achieved in the updraft system by the use of gravity or pumps, for example.

Thus, the production of atomized powder by the apparatus and process of the invention as herein described is thus carried out in a safer and more economical manner. Minor modifications of the herein described embodiments may be apparent to those skilled in the art and is deemed to be within the scope of the invention as defined by the appended claims.

What is claimed is:

1. An apparatus for controlling the size of particles in the production of atomized metal comprising:

(a) a containment vessel comprising a first cylindrical wall, a second cylindrical wall, and an end plate through which atomizing gas and molten metal from a molten metal source enter said vessel through nozzle means sealed thereto;

(b) a restricted air ingress port between said first and second cylindrical walls in said vessel spaced from said end plate, one of said cylinder walls and end plate cooperating with said nozzle means to seal off the interior of said vessel and the metal particles therein from the area adjacent the source of molten metal; and (c) means for maintaining a predetermined pressure on the molten metal entering said vessel through said nozzle means to control the particle size of the atomized metal produced in said apparatus.

2. The apparatus of claim 1 wherein said source of molten metal including a reservoir having at least a portion above said nozzle means whereby the metal level in said reservoir provides an adjustable pressure head for the metal entering said vessel through said nozzle means.

3. The apparatus of claim 2 wherein the pressure of said molten metal is adjusted by varying the level of molten metal in said reservoir.

4. The apparatus of claim 3 wherein said containment vessel and said reservoir are positioned adjacent to permit gravity flow of molten metal from said reservoir into said vessel through said nozzle means.

5. The apparatus of claim 3 wherein said reservoir and said vessel are connected together by a plurality of nozzles.

6. The apparatus of claim 3 wherein said reservoir is positioned above said vessel.

7. The apparatus of claim 6 wherein the flow of atomized metal particles in said vessel is in a downwardly direction from said reservoir.

8. The apparatus of claim 6 wherein the flow of atomized metal particles in said vessel is in a substantially horizontal direction from said reservoir.

9. Apparatus for controlling the particle size in the production of atomized metal which comprises:

(a) reservoir means for providing a source of molten metal;

(b) a containment vessel comprising a first cylinder terminating in an end plate and a second cylinder received within said first cylinder, said second cylinder having a conical shaped end portion with an open end facing said end plate, said cylinders having a portion therebetween defining a gas ingress port;

(c) nozzle means for introducing atomizing gas and said molten metal from said reservoir into said containment vessel in finely divided particles;

(d) means for controlling the pressure of the molten metal entering said vessel from said reservoir through said nozzle means to control the particle size of the atomized metal particles produced by said apparatus; and (e) means for introducing a sweeping gas into said vessel through said gas ingress port therein to sweep said particles from said containment vessel.

10. The apparatus of claim 9 wherein said cylinders comprising said containment vessel are horizontally disposed and said second cylinder is provided with a series of openings along the bottom of said second cylinder whereby a portion of said sweeping gas passing between said first and second cylinders enters said second cylinder through said openings to sweep away any particles which fall to the bottom of said second cylinder.

* * * * *